United States Patent [19]

Achikita et al.

[11] Patent Number: 5,032,355

[45] Date of Patent: Jul. 16, 1991

[54] METHOD OF MANUFACTURING SINTERING PRODUCT OF FE-CO ALLOY SOFT MAGNETIC MATERIAL

[75] Inventors: Masakazu Achikita, Kashiwa; Akihito Ohtsuka, Sakura; Shinichi Sogame, Yamato, all of Japan

[73] Assignee: Sumitomo Metal Mining Company Limited, Tokyo, Japan

[21] Appl. No.: 591,983

[22] Filed: Oct. 1, 1990

[51] Int. Cl.[5] ..... C22C 32/00

[52] U.S. Cl. ..... 419/23; 419/25; 419/29; 419/38; 419/54

[58] Field of Search ..... 419/23, 25, 29, 38, 419/54

[56] References Cited

U.S. PATENT DOCUMENTS

| | | | |
|---|---|---|---|
| 4,221,613 | 9/1980 | Imaizumi et al. | 148/103 |
| 4,369,075 | 1/1983 | Nobuo et al. | 148/102 |
| 4,601,876 | 7/1986 | Yamashita et al. | 419/23 |
| 4,925,502 | 5/1990 | Yamagishi et al. | 148/311 |
| 4,968,347 | 11/1990 | Ramesh et al. | 75/244 |

*Primary Examiner*—Stephen J. Lechert, Jr.
*Assistant Examiner*—N. Bhat
*Attorney, Agent, or Firm*—Watson, Cole, Grindle & Watson

[57] ABSTRACT

A method of manufacturing a sintering product of Fe-Co alloy soft magnetic material by molding a powder comprising from 40 to 60% by weight of Co and the substantial balance of Fe, sintering the molding product and then applying heat treatment, wherein cooling after the heat treatment is conducted as slow cooling at a cooling rate of not more than 50° C./min.

4 Claims, No Drawings

METHOD OF MANUFACTURING SINTERING PRODUCT OF FE-CO ALLOY SOFT MAGNETIC MATERIAL

BACKGROUND OF THE INVENTION

1. Field of the Invention

The present invention concerns a method of manufacturing a sintering product of Fe-Co alloy soft magnetic material.

2. Description of the Prior Art

Fe-Co alloy soft magnetic materials are alloy materials having an order-disorder transformation point and forming a CsCl type ordered lattice phase and, since they show the highest saturation magnetic flux density among alloys known at present, they have been widely used as a magnetic yoke material for pulse motors, printer heads, etc., and vibration plates for headphones.

When the alloy consists only of Fe and Co, the order transformation can not be suppressed by any heat treatment and cold working is impossible. As such it has been necessary to add expensive V or Cr for improving workability. However, even this is not sufficient for completely suppressing the order transformation. Cutting fabrication is necessary for obtaining molding products such as parts, especially. those of complicated shapes, but they are fragile and impossible to be cut because of the presence of the ordered phase and, accordingly, it has been impossible so far to fabricate Fe-Co alloys prepared by melting process into molding products, especially, those having complicated shapes. Furthermore, incorporation of additive elements as described above results in a deterioration of the soft magnetic property.

For overcoming such a drawback, although there has been attempted to produce them by using powder metallurgy, this still involves a problem. For instance, Japanese Patent Laid Open Sho No. 62-63617 discloses a method of mixing starting powders with a composition of Fe/Co=1 by atom ratio, admixing a lubricant to prepare a dust core, removing the lubricant, applying preliminary sintering at 750°-850° C. in hydrogen, applying compression molding again, applying sintering in hydrogen at 1300°-1400° C., maintaining the product in a hydrogen atmosphere at 800°-900° C. and then applying oil quenching.

The thus-obtained sintering product has improved magnetic characteristics when applying heat treatment (cooling applied by quenching) as compared with leaving the product as sintered, but the magnetic flux density and the maximum magnetic permeability are poor as compared with the magnetic characteristics of products prepared by a melting process and they are not yet satisfactory for practical use.

OBJECT OF THE INVENTION

It is, accordingly, an object of the present invention to overcome the foregoing drawbacks in the prior art and provide a method capable of manufacturing a sintering product of Fe-Co alloy material having soft magnetic characteristics as comparable with those of materials prepared by a melting process.

SUMMARY OF THE INVENTION

The present inventor has made an earnest study for attaining the foregoing object and, as a result, has found that in a method of manufacturing a sintering product of Fe-Co alloy soft magnetic material by molding and sintering a powder comprising from 40 to 60% by weight of Co, the balance being substantially Fe, followed by applying heat treatment, the lattice strain caused upon cooling after sintering or after heat treatment deteriorates the magnetic characteristics. The inventor found that the foregoing object can be attained by conducting cooling after the heat treatment as a gradual cooling, i.e., at a cooling rate of not more than 50° C./min.

That is, the foregoing object of the present invention can be attained by the method of at first mixing an Fe powder and a Co powder such that the mixture comprises from 40 to 60% by weight of Co and the substantially balance of Fe, and, if necessary, further mixing and blending an Fe-Co alloy powder, applying press molding or injection molding to the resultant powder mixture into a predetermined shape, removing a binder while maintaining the molding product at 300° C. if necessary, sintering the product within a temperature range from 1100° to 1450° C. then applying a heat treatment at a temperature from 700° to 850° C., and then applying gradual cooling at a cooling rate of not more than 50° C./min. The molding may be conducted by press molding or injection molding, but injection molding is best when manufacturing products of complicated shapes. Further, the grain size of Fe powder, Co powder and Fe-Co alloy powder is desirably not greater than 45 μm.

It is necessary that the blended powder and the sintering product after sintering contains from 40 to 60% by weight of Co. If the Co content is less than 40% by weight, although the magnetic flux density is not reduced by so much, the maximum magnetic permeability is remarkably lowered and it can not be used as a soft magnetic material. When the Co content exceeds 60% by weight, although the magnetic flux density is not lowered by much, the maximum magnetic permeability is again reduced remarkably and it can not be used as a soft magnetic material. It is desirable that elements other than Fe and Co are not included but they may be incorporated within such a range that the magnetic flux density $B_{35}$ as the soft magnetic property of the sintering product is not reduced to lower than 20,000 G.

A binder, for example, of paraffin wax type is added to the thus-blended powder for molding and the binder is removed subsequently at a temperature of about 300° C. The temperature for removing the binder may be selected appropriately depending on the nature of the binder used for the molding.

The temperature of sintering is desirably from 1100° to 1450° C. If the temperature is lower than 1100° C., reduced sintering occurs even when the material is maintained for a long time and the relative density of the sintering product does not increase and, as a result, the magnetic characteristics are not improved.

On the contrary, if the sintering temperature exceeds 1450° C., although the sintering product at high density can be obtained, a liquid phase may possibly be formed, causing loss of a shape or surface melting, thus interfering with the production of a product having a predetermined shape and size.

The heat treatment after sintering may be conducted in the course of the cooling after the completion of the sintering, or a heat treatment may be applied by heating the sintering product again which was once cooled after sintering. Thus heat treatment is desirably applied at a temperature range from 700° to 850° C.

If it is lower than 700° C., lattice strains caused during sintering are not released and no appropriate grain growth occurs. As a result, soft magnetic characteristics are not improved as compared with those just after the sintering. On the other hand, at a temperature in excess of 850° C., the tissue after cooling constitutes an austeniteferrite 2 phase tissue which deteriorates the soft magnetic characteristics.

The Fe-Co alloy forms a disorder texture at a heat treatment temperature of 700° to 850° C. If the alloy is quenched from this state, although the disorder state tends to be frozen, an order state is partially present. If the alloy to be applied with the heat treatment is single crystals or polycrystals having a texture, soft magnetic characteristics are improved providing that the disordered state is maintained. However, since the sintering product manufactured by the method according to the present invention, comprises a polycrystal form in which the texture is not present, there is less necessity that the disorder state is maintained. On the other hand, if lattice strains are present in the sintering product, they bring about an undesired effect that the movement of magnetic walls is hindered to deteriorate the soft magnetic characteristics. Accordingly, cooling after the heat treatment has to be conducted as a slow cooling at a cooling rate of not more than 50° C./min. At a cooling rate in excess of 50° C./min the lattice strains are formed during cooling which remain as they are to a room temperature, thus soft magnetic characteristics are deteriorated.

It is desirable that the grain size of Fe powder, Co powder and Fe-Co alloy powder blended initially is not greater than 45 μm. In a powder with the grain size of greater than 45 μm, the amount of the binder is increased and the proceeding of the sintering is slow. Therefore, final relative density of the sintering product is not increased and the magnetic characteristics are less improved.

EXAMPLE

Carbonyl Fe powder with an average grain size of 5 μm, reduced co powder with an average grain size of 4.5 μm and, if necessary, Fe-Co alloy powder of 50 wt % Co content with a grain size of not greater than 45 μm were used as the starting powder and, after blending and mixing them in each of blending ratios shown in Table 1, a wax type binder was added to the blend such that the binder content was from 40 to 50% by volume and then they were kneaded at 150° C. and then granulated into pellets. The pellets were injection molded into a die by using an injection molding machine under the condition of an injection molding pressure at 1200 kg/cm$^2$. The wax type binder was removed while maintaining the resultant molding product at 300° C. Subsequently, the product was sintered at a temperature within a range from 1050° C. to 1490° C., applied with heat treatment under heat treatment conditions shown in Table 1 and then cooled slowly to 400° C. at a cooling rate also shown in Table 1 and then allowed to cool in a furnace to a normal temperature. The thus obtained sintering product was wound around excitation coils and search coils both by 50 turns, and BH hysteresis curve was drawn by using a DC recording magnetic flux meter, to obtain magnetic flux density ($B_{35}$), coersive force (HC), maximum magnetic permeability ($\mu_m$) under an external magnetic field of 35 Oe. The results are shown in Table 1.

Comparative Example (1) shows the result of measurement for rod-like products obtained from products prepared by melting process from 2V–49Co–Fe by % by weight by applying hot working, heat treatment and slow cooling, for the comparison, which were not produced by the powder metallurgy as described above.

Further, Comparative Examples (2)–(11) were manufactured by the same process as in the example of the present invention but by changing the composition, grain size of the starting powder, sintering temperature, heat treatment temperature and cooling rate after heat treatment. Further, since the cooling in Comparative Examples (2), (3) and (4) relies on the quenching method and, accordingly, it does not the cooling rate down to 400° C. but the cooling down to the normal temperature.

It can be seen from Table 1 that the soft magnetic characteristics of the sintering products manufactured by the method according to the present invention are excellent having high magnetic flux density, low coersive force and high magnetic permeability.

In Comparative Example (2), cooling after the heat treatment is applied as quenching I (oil cooling) and the cooling rate exceeds 50° C./min as the upper limit in claim 1 described later.

In Comparative Example (3) cooling after the heat treatment is applied as quenching II (cooling in water at 25° C.) and the cooling rate exceeds 50° C./min as the upper limit in claim 1 described later.

In Comparative Example (4), cooling after the heat treatment is applied as quenching III (cooling in ice plus water at 0° C.) and the cooling rate exceeds 50° C./min as the upper limit in claim 1 described later.

In Comparative Example (5), the heat treatment temperature is 900° C., which exceeds 850° C. as the upper limit for the heat treatment temperature in claim (3) described later.

In Comparative Example (6), the heat treatment temperature is 650° C., which is lower than 700° C. as the lower limit for the heat treatment temperature in claim (3) described later (lower than).

In Comparative Example (7), the sintering temperature is 1050° C. and sintering is applied at a temperature lower than 1100° C. which is the lower limit for the sintering temperature in claim (2) described later.

In Comparative Example (8), the sintering temperature is 1490° C. and sintering is applied at a temperature higher than 1450° C. which is the higher limit for the sintering temperature in claim (2) described later.

In Comparative Example (9), the content of Co is 35% by weight in the composition which is less than 40 wt % as the lower limit of the Co content in claim 1.

In Comparative Example (10), the Co content is 65% by weight which is greater than 60% by weight as the upper limit of the Co content in claim (1).

In Comparative Example (11), the grain size of the starting powder is within a range of 53 to 63 μm and, which is a power coarser than 45 μm which is the upper limit for the grain size of the starting powder in claim (4).

TABLE 1

| Processing conditions for production | |
|---|---|
| Starting powder | |

TABLE 1-continued

| | | Alloy composition | blend (wt %) Fe powder | Co powder | Fe—Co powder | Sintering | Heat treatment and cooling: Temp. × retention time | Cooling rate |
|---|---|---|---|---|---|---|---|---|
| Example | (1) | 50 wt % Co—Fe | 25 | 25 | 50 | 1400° C. × 1 hr. | 800° C. × 2 hr.→slow cooling | 2° C./min |
| | (2) | " | " | " | " | " | 775° C. × 2 hr.→slow cooling | " |
| | (3) | " | " | " | " | " | 750° C. × 2 hr.→slow cooling | " |
| | (4) | " | " | " | " | " | 800° C. × 2 hr.→slow cooling | 1° C./min |
| | (5) | 45 wt % Co—Fe | 55 | 45 | 0 | " | 800° C. × 2 hr.→slow cooling | 2° C./min |
| | (6) | 55 wt % Co—Fe | 45 | 55 | 0 | " | 800° C. × 2 hr.→slow cooling | " |
| | (7) | 50 wt % Co—Fe | 25 | 25 | 50 | " | furnace cooling after sintering | 8° C./min |
| | (8) | " | " | " | " | " | 800° C. × 2 hr.→slow cooling | 50° C./min |
| Comp. Example | (1) | 2 wt % V—49 wt % Co—Fe | | | | | 800° C. × 2 hr.→slow cooling | 2° C./min |
| | (2) | 50 wt % Co—Fe | 25 | 25 | 50 | 1400° C. × 1 hr. | 800° C. × 2 hr.→quenching I | 200° C./min |
| | (3) | " | " | " | " | " | 800° C. × 2 hr.→quenching II | 400° C./min |
| | (4) | " | " | " | " | " | 800° C. × 2 hr.→quenching III | 600° C./min |
| | (5) | " | " | " | " | " | 900° C. × 2 hr.→slow cooling | 2° C./min |
| | (6) | " | " | " | " | " | 650° C. × 2 hr.→slow cooling | " |
| | (7) | " | " | " | " | 1050° C. × 1 hr. | 800° C. × 2 hr.→slow cooling | " |
| | (8) | " | " | " | " | 1490° C. × 1 hr. | | |
| | (9) | 35 wt % Co—Fe | 65 | 35 | 0 | 1400° C. × 1 hr. | 800° C. × 2 hr.→slow cooling | 2° C./min |
| | (10) | 65 wt % Co—Fe | 35 | 65 | 0 | " | 800° C. × 2 hr.→slow cooling | " |
| | (11) | 50 wt % Co—Fe | 25 | 25 | 50 | " | 800° C. × 2 hr.→slow cooling | " |

| | | Magnetic Characteristics: $B_{35}$ (G) | Hc (Oe) | μm (G/Oe) | Note |
|---|---|---|---|---|---|
| Example | (1) | 20,400 | 4.0 | 4,650 | |
| | (2) | 20,000 | 2.6 | 3,100 | |
| | (3) | 20,000 | 3.2 | 3,000 | |
| | (4) | 20,500 | 3.9 | 4,800 | |
| | (5) | 20,900 | 3.5 | 4,500 | |
| | (6) | 20,000 | 3.5 | 3,600 | |
| | (7) | 20,000 | 2.0 | 4,000 | heat treatment upon cooling after sintering |
| | (8) | 18,000 | 5.0 | 2,500 | |
| Comp. Example | (1) | 20,900 | 5.2 | 1,676 | Product by melting |
| | (2) | 11,000 | 7.7 | 750 | |
| | (3) | 9,000 | 9.5 | 620 | |
| | (4) | 6,000 | 12.0 | 350 | |
| | (5) | 16,000 | 6.0 | 1,100 | |
| | (6) | 14,000 | 6.8 | 1,020 | |
| | (7) | 5,000 | 5.0 | 1,010 | |
| | (8) | | | | Shape lost |
| | (9) | 20,000 | 3.0 | 1,000 | |
| | (10) | 16,000 | 3.5 | 1,600 | |
| | (11) | 11,000 | 2.0 | 900 | Starting powder 53-63 um |

As has been described above specifically, by the method of manufacturing a sintering product of Fe-Co alloy soft magnetic material according to the present invention, excellent soft magnetic material having high magnetic flux density, low coersive force and high magnetic permeability at least comparable with those of the soft magnetic material of Fe-Co alloy obtained so far by the melting process with addition of V can be obtained. In addition, since the injection molding process can be applied, it has also another effect capable of providing soft magnetic materials of Fe-Co alloy of complicated shapes.

What is claimed is:

1. A method of manufacturing a sintering product of Fe-Co alloy soft magnetic material by molding a powder comprising from 40 to 60% by weight of Co and the substantial balance of Fe to form a molding product, sintering the molding product, then applying a heat treatment, and then cooling after the heat treatment at a cooling rate of not more than 50° C./min.

2. A manufacturing method as defined in claim 1, wherein the sintering is conducted at a temperature from 1100° to 1450° C.

3. A manufacturing method as defined in claim 1, wherein the heat treatment is applied at a temperature from 700° to 850° C.

4. A manufacturing method as defined in claim 1, wherein the grain size of the powder is not greater than 45 μm.

* * * * *